US010655459B2

(12) United States Patent
Fraignac et al.

(10) Patent No.: US 10,655,459 B2
(45) Date of Patent: May 19, 2020

(54) TUBULAR DEVICE WITH RADIOFREQUENCY COMMUNICATION FOR WELL HEAD

(71) Applicants: Alexandre Fraignac, Paris (FR); Yannick Mfoulou, Massy (FR)

(72) Inventors: Alexandre Fraignac, Paris (FR); Yannick Mfoulou, Massy (FR)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/121,790

(22) Filed: Sep. 5, 2018

(65) Prior Publication Data

US 2019/0242247 A1 Aug. 8, 2019

Related U.S. Application Data

(63) Continuation of application No. 14/127,584, filed as application No. PCT/EP2012/062063 on Jun. 22, 2012, now abandoned.

(60) Provisional application No. 61/536,843, filed on Sep. 20, 2011, provisional application No. 61/536,708, (Continued)

(30) Foreign Application Priority Data

Jun. 22, 2011 (FR) ..... 11 01924
Jun. 22, 2011 (FR) ..... 11 01925
Jun. 22, 2011 (FR) ..... 11 01926

(51) Int. Cl.

*E21B 47/12* (2012.01)
*E21B 17/00* (2006.01)
*E21B 21/10* (2006.01)

(52) U.S. Cl.

CPC ..... *E21B 47/122* (2013.01); *E21B 17/003* (2013.01); *E21B 21/106* (2013.01)

(58) Field of Classification Search

None

See application file for complete search history.

(56) References Cited

U.S. PATENT DOCUMENTS 3,746,106 A * 7/1973 McCullough ..... E21B 7/04 340/853.5
3,996,804 A * 12/1976 Neufeld ..... B64G 1/26 73/457

(Continued)

*Primary Examiner* — Steven Lim
*Assistant Examiner* — Muhammad Adnan
(74) *Attorney, Agent, or Firm* — Cantor Colburn LLP

(57) ABSTRACT

An element for a drill string including a body with a generally axisymmetric appearance and a wave type communication device installed in the body. The communication device includes a set of antennae including plural antennae distributed at a periphery of the body, about an axis of symmetry thereof, and capable of operating in transmission and in reception, operating electronics capable of organizing transfer of data, in transmission and in reception, an actuator capable of selectively connecting the antennae of the set to the operating electronics, and an antenna monitor configured to regularly evaluate a reception quality parameter for at least one sub-assembly of the set of antennae, to repetitively select one or more antennae of the set as a function of reception quality parameters derived from the sub-assembly and to command the actuator to connect the selected antenna or antennae to the operating electronics.

17 Claims, 14 Drawing Sheets

Related U.S. Application Data filed on Sep. 20, 2011, provisional application No. 61/536,763, filed on Sep. 20, 2011.

(56) References Cited

U.S. PATENT DOCUMENTS 4,780,862 A * 10/1988 Clerke ..... G01V 1/52 181/402
4,977,615 A * 12/1990 Suzuki ..... H04B 7/0805 455/277.2
5,799,245 A * 8/1998 Ohashi ..... H04B 7/0604 455/101
5,815,112 A * 9/1998 Sasaki ..... G01S 13/87 342/113
6,047,019 A * 4/2000 Ishii ..... H04B 7/0814 343/703
6,068,217 A * 5/2000 Stoen ..... B64G 1/24 244/164
7,024,168 B1 * 4/2006 Gustafsson ..... H04B 7/0877 455/101
7,043,218 B1 * 5/2006 Ogino ..... H04B 7/0808 455/226.2
7,499,691 B1 * 3/2009 Dunn ..... H04B 7/0814 455/101
7,571,643 B2 * 8/2009 Sugiura ..... E21B 7/062 73/152.46
7,839,346 B2 * 11/2010 Bittar ..... H01Q 1/04 343/719
8,322,226 B2 * 12/2012 Amanullah ..... G01N 3/40 73/821
8,463,548 B2 * 6/2013 Gies ..... E21B 47/01 702/9
9,074,443 B2 * 7/2015 Gray ..... E21B 21/08
9,476,425 B2 * 10/2016 Atherton ..... E21B 43/128
9,933,538 B2 * 4/2018 Lim ..... G01V 1/46
10,214,980 B2 * 2/2019 Orban ..... G01N 11/00
10,378,330 B2 * 8/2019 Estes ..... E21B 49/003
10,436,021 B2 * 10/2019 Ash ..... E21B 47/12
2003/0032403 A1 * 2/2003 Ono ..... H04B 7/0814 455/273
2005/0170800 A1 * 8/2005 Taromaru ..... H04B 7/0814 455/191.3
2005/0185618 A1 * 8/2005 Friday ..... G01S 5/0252 370/331
2006/0012531 A1 * 1/2006 Kinney ..... G06F 1/1626 343/702
2006/0219438 A1 * 10/2006 Moore ..... E21B 47/122 175/50
2006/0232492 A1 * 10/2006 Sawatani ..... H01Q 1/2266 343/893
2007/0030167 A1 * 2/2007 Li ..... E21B 17/003 340/855.1
2007/0137869 A1 * 6/2007 MacDougall ..... E21B 34/066 166/386
2007/0173303 A1 * 7/2007 Viorel ..... H01Q 1/246 455/575.7
2007/0257811 A1 * 11/2007 Hall ..... E21B 47/122 340/854.6
2009/0027260 A1 * 1/2009 Runyon ..... H01Q 1/42 342/352
2010/0182161 A1 * 7/2010 Robbins ..... E21B 47/122 340/853.7
2010/0214121 A1 * 8/2010 Puro ..... E21B 44/00 340/854.6
2010/0224409 A1 * 9/2010 Sarhad ..... E21B 17/003 175/40
2011/0068949 A1 * 3/2011 Ieda ..... G08G 1/0965 340/902
2012/0203400 A1 * 8/2012 Schultes ..... B60C 23/0416 701/1
2012/0234605 A1 * 9/2012 Donderici ..... G01V 1/46 175/73

* cited by examiner

Fig. 11
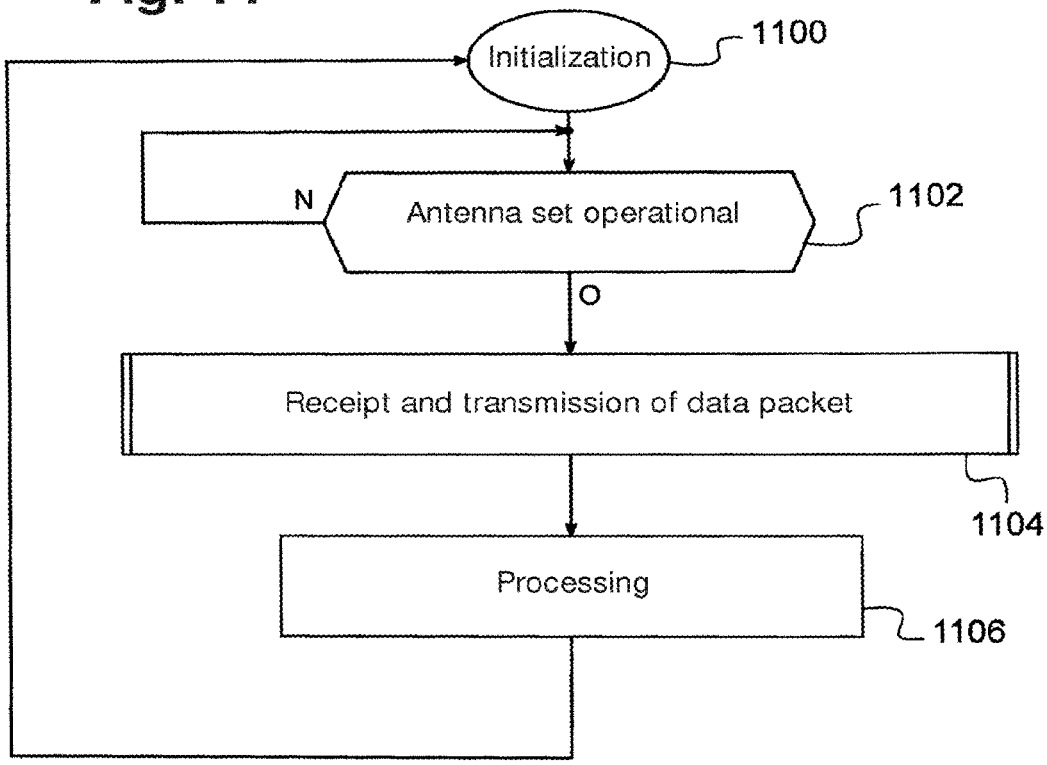
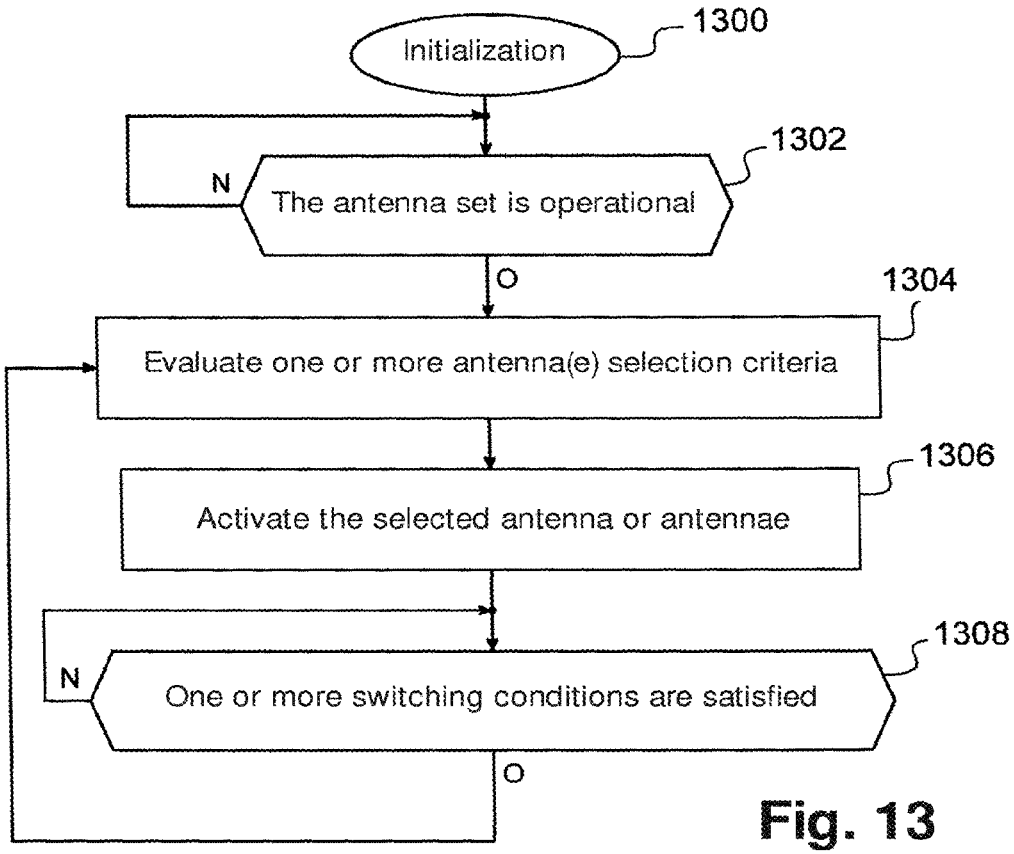
Fig. 13

TUBULAR DEVICE WITH RADIOFREQUENCY COMMUNICATION FOR WELL HEAD

CROSS REFERENCE TO RELATED APPLICATIONS

This application is a continuation and claims the benefit of an earlier filing date from U.S. application Ser. No. 14/127,584 filed on Jan. 7, 2014, which is a U.S. National Stage of Application No. PCT/EP2012/062063 filed Jun. 22, 2012, which claims the benefit of U.S. Provisional Application Ser. No. 61/536,843 filed Sep. 20, 2011 and U.S. Provisional Application Ser. No. 61/536,708 filed Sep. 20, 2011, and U.S. Provisional Application Ser. No. 61/536,763 filed Sep. 20, 2011, and also claims the benefit of French Application Serial Number 11 01925 filed Jun. 22, 2011, French Application Serial Number 11 01924 filed Jun. 22, 2011 and French Application Serial Number 11 01926 filed Jun. 22, 2011 the entire disclosures of which are incorporated herein by reference.

BACKGROUND

The invention relates to deep or long wells, in particular oil wells.

As an oil well advances, from time to time one or more tubes have to be added at the well head. For this reason, such a well comprises a vertical support structure on the surface which is known as a derrick.

In general, the derrick and the equipment it contains, in particular the rotary drive system, will be known herein as the "well head equipment".

As will be seen in more detail below, the area of the well head equipment is a cramped space. The derrick carries a mechanical system which can hold the drill string as well as lift and drop it. When pulling the drill string, the upwards vertical excursion is ten meters or more. This is also the case for the downwards vertical excursion during drilling.

The well head equipment also includes the rotary drive for the string, for drilling, and also the system that can break out and make up one or more tubes (or other equipment) onto the formed string. To this is added a system for injecting and recovering drilling mud which in particular actuates the drill bit. Finally, various types of safety systems are necessary.

The search is currently on to make the drill string communicative, so that information can be exchanged between the top and bottom of the well or between intermediate equipment inserted in the string. To this end, within the string, each tube is provided with communication couplers at its ends and an electrical connection between those couplers.

At the top of the well, it is helpful to pass data between the string, which rotates and is displaced vertically, and fixed electronic equipment on the surface. The connection between the string and this surface electronic equipment is known herein as the "surface interface".

Selecting this surface interface connection is critical. If this connection is interrupted, the communication equipment provided in the string itself becomes useless and all of the information and commands it relies upon is lost.

A number of solutions can be envisaged. Of these, few are actually applicable in practice, due to the many constraints placed upon it, in particular the cramped environment of the well head equipment.

As an example, US 2010/0214121 describes a drill string provided with a communication device comprising a single transmitter capable of carrying out wireless transmission with one or more fixed "coordinators". Said coordinators are in fact receiving antennae located at the well head. The envisaged transmission conforms to IEEE standard 802.15.4, which allows data transfer at a fairly low rate.

The communication device in question uses control or marker signals originating from the coordinators in order to determine the best available coordinator and/or, for one coordinator in particular, the best moment to transmit data to it.

Data transmission is limited to a portion of the rotational gate of the string, typically an arc of 120.degree., or to certain time periods. This is intended to minimize the energy consumed for data transmission.

It is then necessary to adjust the transmitter on the coordinators to determine the time periods which are favorable for data transfer: once a valid coordinator has been detected, the rate of rotation of the string is used to determine a succession of transmission time periods which correspond to successive passes of the transmitter in the vicinity of the coordinator in question.

The device known from US 2010/0214121 suffers from a number of disadvantages.

As has been seen, the rate of rotation of the string must be known, but it is likely to vary with time, for example as drilling problems crop up. Typically, supplemental sensors have to be installed in the string, which causes problems with integration thereof and electrical supply thereto.

Further, for high rates of rotation, little time is available to carry out data transfer properly.

It also appears that the device in question only accommodates a fairly reduced transfer rate, which may prove to be insufficient, primarily because of recent improvements in the field of sending information from the well bottom.

Finally, it is not a simple matter of multiplying the number of coordinators, i.e. the receiving antennae, since as has been seen above, the environment of the well head equipment is already very cramped and filled with elements that are vital to the drilling operations.

US 2010/0224409 A1 describes a wear insert or saver sub which is used to connect the drill string to the drive system. Said wear insert is equipped with antennae which allows wireless data transmission with a surface antenna produced in the form of a parabolic antenna. According to US 2010/0224409 A1, transmission/reception of data can be carried out in practically any direction, in particular over 360.degree. around the wear insert, which means that communication should be established even when the wear insert is driven in rotation or displaced in any manner. The function of said antennae is not explained in more detail. The idea appears to be to irradiate the antennae array around the wear insert as widely as possible in all directions so that the parabolic antenna can practically always capture data transmitted by the insert in question. The system in US 2010/0224409 A1 does not overcome certain problems which arise in practice in the art, such as the energy consumption of the onboard electronic elements or the cramped space in the well environment, to mention just a few.

The present invention will improve the situation.

SUMMARY

It proposes an element for a drill string of the type comprising a body with a generally axisymmetric appearance and a wave type communication device installed in said body. This element is remarkable in that the communication device comprises a set of antennae comprising a plurality of antennae distributed at the periphery of said body, about the axis of symmetry thereof, and capable of operating in transmission and in reception, operating electronics which are capable of organizing the transfer of data, in transmission and in reception, an actuator which is capable of selectively connecting the antennae of said set to the operating electronics, and an antenna monitor arranged to regularly evaluate a reception quality parameter for at least one sub-assembly of the set of antennae, to repetitively select one or more antennae of said set as a function of reception quality parameters derived from said sub-assembly and to command the actuator to connect the selected antenna or antennae to the operating electronics.

The proposed element allows communication between the drill string and one or more fixed devices on the surface, at an excellent rate and with a low energy consumption.

Optional characteristics of the invention, which may be complementary, supplemental or substitutional, are mentioned below:

- the selected antenna or antennae comprise one or more antennae selected from said sub-assembly and/or one or more antennae close to the antennae of said sub-assembly;
- the antenna monitor is also arranged to regularly evaluate a switching criterion and to operate the actuator each time the switching criterion is verified;
- the switching criterion comprises a comparison between a time elapsed from the last activation and a predetermined time period;
- the predetermined time period is calculated from a value for the rate of rotation of said body, taking into account the distribution of the antennae about the axis of symmetry of the body;
- the value for the rate of rotation is determined from the change with time of the reception quality parameter of at least one of the activated antennae;
- the switching criterion comprises a comparison of substantially instantaneous values for the reception quality parameters relating to the activated antennae on the one hand and on the other hand to the other antennae of said sub-assembly;
- the operating electronics are capable of toggling repetitively between a reception mode and a transmission mode;
- the operating electronics are arranged to operate in transmission mode for a time period of a predetermined duration and to toggle into transmission mode in the absence of modification of the antennae to which it is connected during said time period;
- the set of antennae comprises a plurality of surface antennae distributed regularly about the axis of symmetry of said body;
- the body houses a safety valve.

The invention also concerns a well head device comprising at least one drill string element as proposed above, as well as a well head comprising at least one such device attached to a drive for rotation with respect to a derrick and one or more antennae fixed with respect to said derrick.

The body of the element may then have an upper end threading, a lower end threading, an end coupler, arranged at its lower end, intended to cooperate with a matching end coupler of another element made up onto the lower end threading, and an electrical connection arranged between the end coupler and the operating electronics. The device may also comprise a valve arranged in the intermediate portion of the body between the upper end threading and the lower end threading.

The invention also pertains to a method for communication by means of a drill string element comprising a body with a generally axisymmetric appearance and a set of antennae, comprising a plurality of antennae distributed at the periphery of said body about its axis of symmetry, and capable of operating in transmission and reception, comprising a step of evaluating at least one reception quality parameter for at least one sub-assembly of the set of antennae, a step of selecting one or more antennae of said set as a function of the reception quality parameter or parameters derived from said sub-assembly, and a step of organization of a transfer of data, in transmission and/or reception, via the selected antenna or antennae.

The evaluation step may be carried out regularly and/or the selection step may be repetitive.

The invention also pertains to a method for drilling, exploration and/or operation of a hydrocarbon well, comprising one or more communication actions carried out in accordance with the above method.

BRIEF DESCRIPTION OF THE DRAWINGS

Further characteristics and advantages of the invention will become apparent from the following detailed description and the accompanying drawings in which:

FIGS. 11 to 13 are flow diagrams illustrating the function of the onboard electronics of FIG. 10;

DETAILED DESCRIPTION

The accompanying drawings essentially contain elements of a concrete nature. As a consequence, they not only serve to provide a better understanding of the detailed description below, but also contribute to the definition of the invention if necessary.

The established terminology for oil drilling is in English, and many of these English terms do not have a general equivalent in French. For this reason, in the present description and for the purposes of clarity, a technical expression from the French will very frequently be accompanied by the corresponding dedicated English expression.

Figure 1:
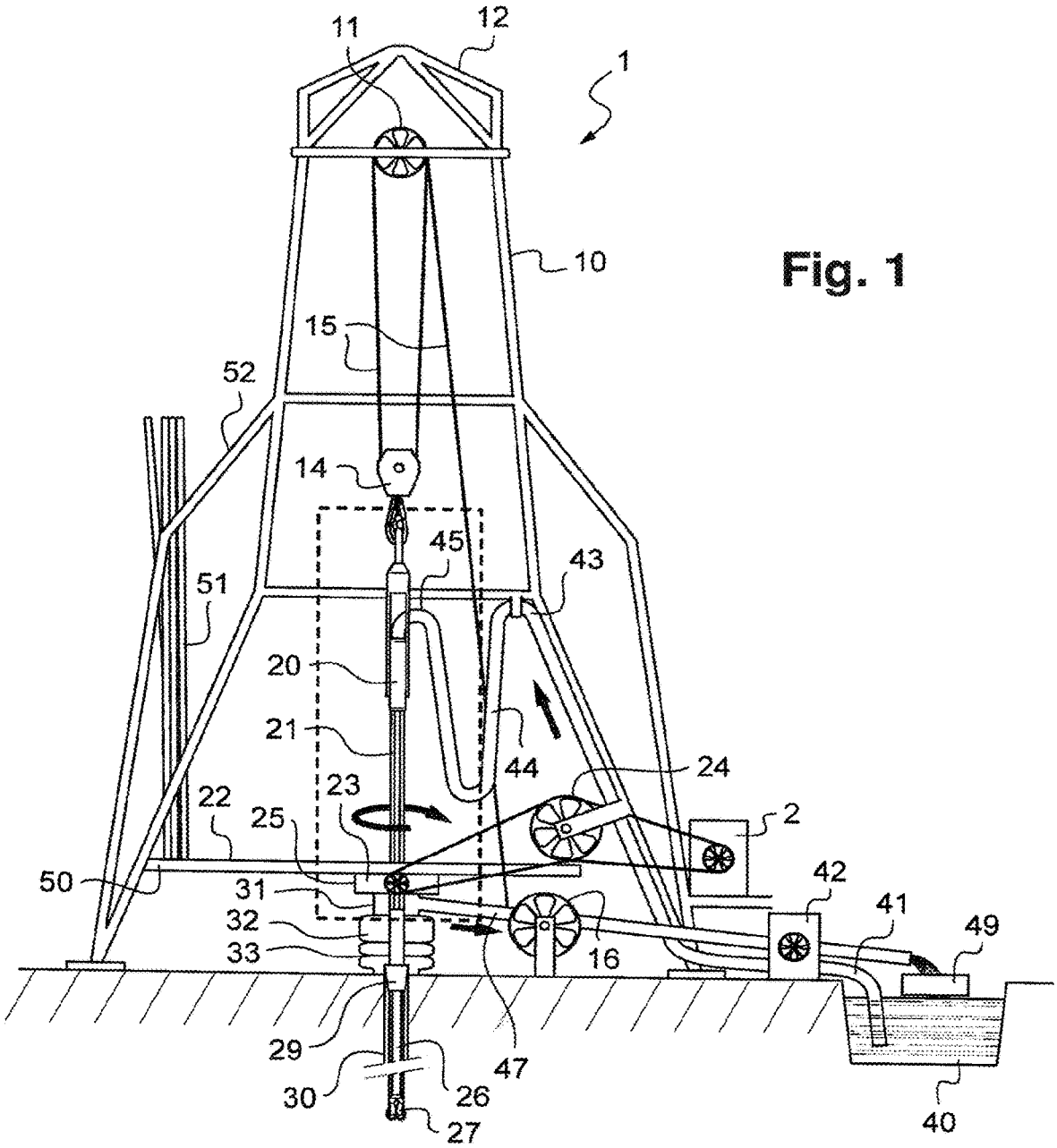
FIG. 1 is a simplified view in side elevation of well head equipment with a traditional rotary table drive.

In FIG. 1, the well head equipment as a whole is designated by the reference numeral 1. It includes the well-known slender pyramid, or derrick 10, at the top of which is an idler sheave 11 housed in a crown 12. The idler sheave 11 supports by cable a terminal sheave or travelling block 14. This assembly forms a hoist which in its turn supports a pivot 20 termed a swivel, which in turn supports an assembly which will be described in further detail below and which comprises a drive system, known as a kelly drive or, more briefly, a kelly. This kelly 21 cooperates with a rotary table 23; its rotary drive is indicated here by a peripheral ring 25 one roller of which is mechanically driven by a chain or belt via an intermediate pulley 24 the shaft of which is in turn driven from the pulley of the output of motor 2. The rotary table 23 is located in the region of a floor 22 of the derrick 10.

At the bottom in the example, the drill string commences at ground level with a casing head 29 attached to the casing 30 of the well. The string or chain of tubes 26, termed the drill string, passes inside this casing 30 and terminates in a drill bit 27 constituted, for example, by rotary abrasive disks.

The idler sheave 11 is driven by a hoist 16 driven by a motor, which is not shown. The reference numeral 15 designates the cable which supports the drill string via the travelling block 14 and the idler sheave 11.

The drill bit 27 requires energy to function and this energy is transmitted to it by pressurized mud and/or by various rotary mechanisms located on the surface or along the drill string, for example one or more motors. Mud is withdrawn from a reservoir 40 via an intake line 41 and is moved to a pump 42 driven by a motor, not shown. This mud lubricates the drill bit 27, cools it, lifts debris from the well bottom, equilibrates its pressure, cleans it and drives some of the equipment of the drill string.

At the outlet from the pump 42, pipework rises along a wall of the derrick 10, ending in a gooseneck 43 from which the pipework drops and rises again to another gooseneck 45, and is attached to the top of the swivel 20 so that mud can enter the string, passing through the kelly 21 to the casing head 29.

The mud then drops through the drill string 26 to cause the drill bit 27 to function. It rises between the string 26 and the casing 30, to the casing head 29, where it is taken up through two safety devices 33 of the valve type, known as blow out preventers: one, known as the blind ram, is capable of crushing the casing 30 annularly to isolate it while the other, termed the shear ram, is capable of severing and closing off the assembly formed by the casing 30 and the string 26.

The mud then rises towards a type of expansion vessel 31 known as a bell nipple, from which it passes into a return line 47 before returning to the reservoir 40 through a device 49 which filters the mud. Gases are filtered out and debris is eliminated.

On the left hand side, the floor 22 is extended at 50 to act as a support for a tube stand 51 held at the top by racking 52 known as a finger board.

It will be understood from the foregoing that between the travelling block 14 and the string 26, at the head of this string, there are elements which provide the rotary drive for said string 26. The elements which are driven are included within the dashed outline, and in this case include the swivel 20, the kelly 21, the rotary table 23 and the peripheral ring 25.

The moving elements, from the central column of the derrick to the travelling block 14, in particular the swivel 20 and the kelly 21, undergo a vertical excursion of ten metres or more.

The derrick houses other elements, not shown in FIG. 1:

- a system for supporting the drill string 26, when it is disconnected from the hoist;
- equipment for manipulating the tubes between the store 51 and the central column;
- a system which can carry out breakouts or makeups on the drill string 26 in order to add or remove a length of tube;
- safety valves, in particular installed at the top of the drill string; a hydraulic clamp to hold the tubes when being made up on the drive.

Figure 2:
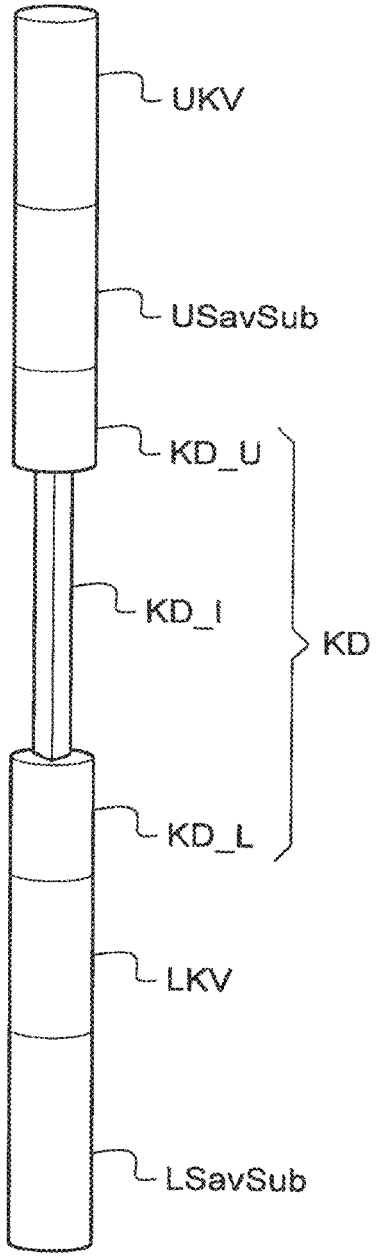
FIG. 2 is a diagram of the made up components used at the head of a drill string in the case of the well head equipment of FIG. 1.

Reference will now be made to FIG. 2. The central portion shows the profiled drive stem termed the kelly. It is a long stem with a polygonal cross section, in principle square or hexagonal, denoted KD_I on FIG. 2. This stem is attached to threaded end shanks denoted KD_U at the top and KD_L at the bottom. The assembly formed by the stem KD_I and its ends KD_U and KD_L is generally denoted the KD (for kelly drive).

The top threading of the upper shank KD_U engages with an upper wear insert, denoted USavSub, surmounted by an upper safety valve termed the upper kelly valve, denoted UKV, and which in principle is actuated manually. At the bottom of the profiled stem KD_I, its lower shank KD_L engages with a lower safety valve termed the lower kelly valve, denoted LKV, which in principle is pneumatic in action, followed by a lower wear insert, LSavSub, to which the drill string 26 will be attached.

The lower wear insert LSavSub may also act as an adapter for the threading. Its lower threading has to be compatible with the threading specified for the string 26. In contrast, its upper threading may be different.

The manual valve may in particular be used as a safety valve in the event of the pneumatic valve not closing off the well completely.

It has been shown that in the well heads of FIGS. 1 and 2, drive is obtained via a rotary table 23; its rotational motion is transmitted to the profiled stem KD_I. A removable bushing (kelly bushing), not shown, defines a profile with a shape corresponding to the square or hexagonal profile of the stem KD_I. The kelly bushing is inserted between the rotary table 23 and said profiled zone KD_I. Thus, the rotary table 23 drives the profiled stem KD_I in rotation while leaving it free in vertical translation to accompany the descent of the drill string 26 as drilling progresses.

Tubes are added as drilling progresses.

Consider now the time when one or more tubes are to be added to the string. The profiled stem KD_I is then completely out of the well and the rotary table 23 is engaged at the bottom of its profiled zone. This is the "top position" of the drill string 26. The stem KD_I descends by sliding as drilling progresses until the top of its profiled zone engages with the rotary table. This is the "bottom position" of the drill string 26. It is then time to add another tube or tubes. To this end, rotation (drilling) is halted, and the kelly bushing is removed; the string 26 is lifted to a height substantially equal to the length of the profiled stem KD_I; the string 26 is locked under the stem KD_I; and the stem KD_I is broken out from the string. A new tube is made up at the top of the string 26. The string 26 is dropped again by the height mentioned above, so that the drill bit 27 is once again at the well bottom. The stem KD_I is made up again onto the top of the string. The kelly bushing is replaced to provide the rotational coupling of the KD_I to the rotary table 23. Drilling can then resume.

Events are substantially similar, with the vertical displacements in the reverse order, when the drill string 26 is to be removed completely or partially. Known techniques allow the casing to be deposited sequentially after drilling a section of the well (to depth).

As drilling progresses, there will thus be many breakout/makeup operations on the same threading of the same component. These breakout/makeup operations are carried out under a high load due to the weight of the string, which may in the end comprise a hundred or several hundred tubes, and hence wear of the threading is rapid. For this reason, it is normal to use one or more wear inserts, known as saver subs, at regions which undergo repeated breakout/makeup operations. In the case of FIGS. 1 and 2, there are two wear inserts respectively placed at the top (USavSub) and the bottom (LSavSub) of the profiled stem KD_I, or kelly. These upper and lower inserts with respect to the profiled stem KD_I are respectively known in the art as the "upper kelly saver sub" and the "lower kelly saver sub".

Figure 3A:
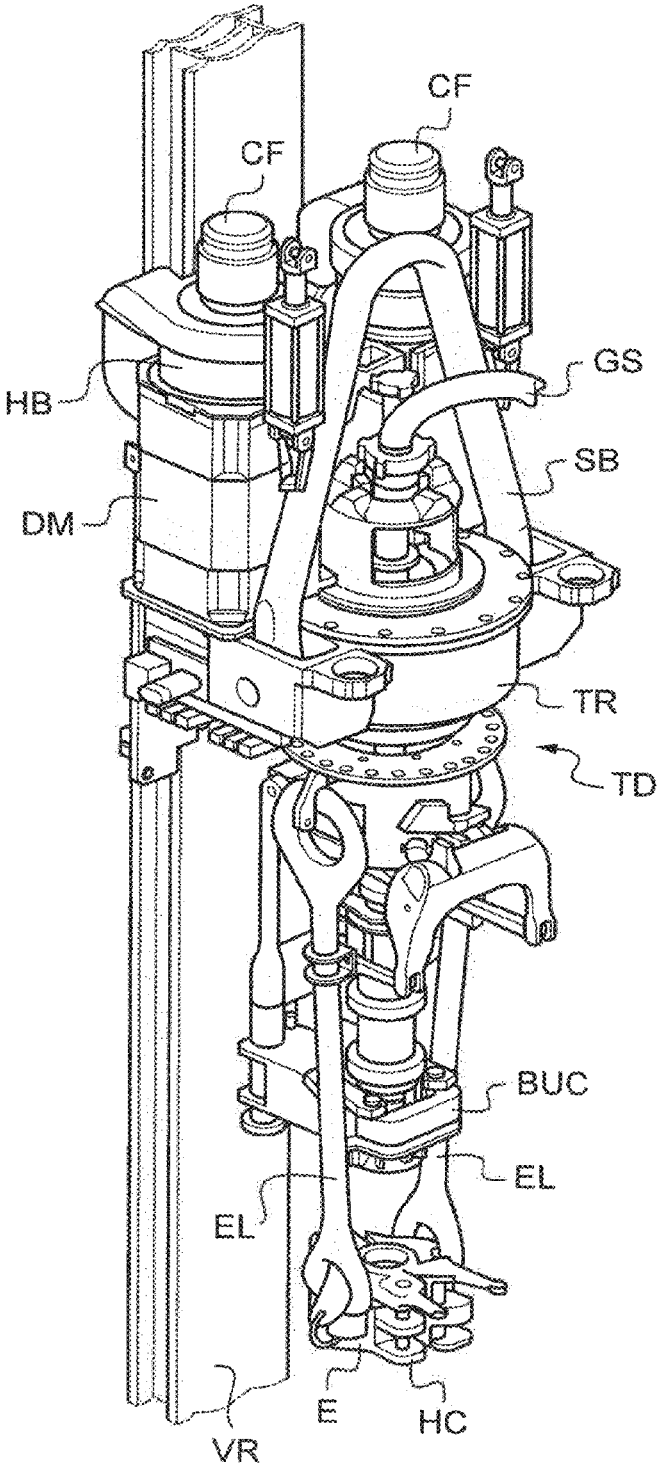
FIG. 3A shows a modern top motor drive in isometric perspective.
Figure 3B:
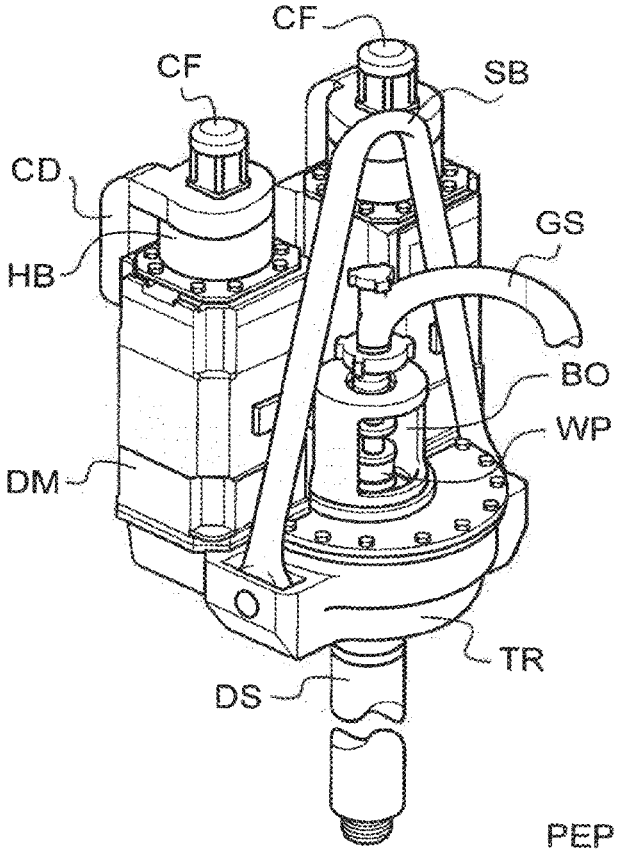
FIG. 3B shows the upper portion of the drive of FIG. 3A.
Figure 3C:
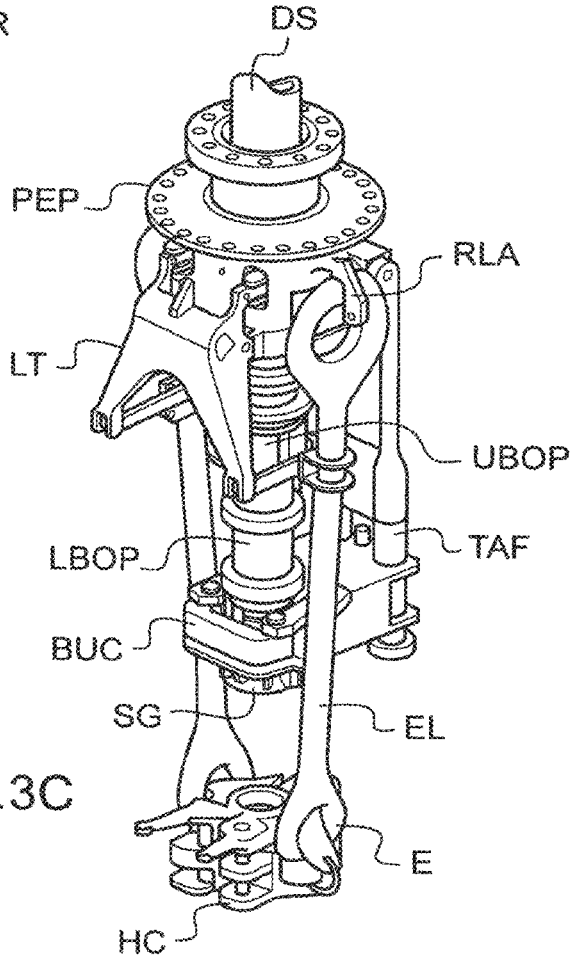
FIG. 3C shows the lower portion of the drive of FIG. 3A.

Reference will now be made to FIGS. 3A, 3B and 3C, which illustrate a more modern embodiment of the well head equipment.

In recent wells, the well head equipment is equipped with a top drive system, denoted TD, shown in its entirety in FIG. 3A. The drive is mounted right at the top of the drill string, supported directly by the travelling block 14 by means of a system bail SB attached to it.

In its upper portion, shown in isolation in FIG. 3B, the top drive system TD comprises an electric motor DM (drilling motor) which drives a drive stem DS in rotation via a transmission TR. This upper portion also comprises a pair of hydraulic brakes HB as well as a cooling system comprising a pair of cooling ducts CD (cooling system air duct) connected to the motor DM and in which air moves by the action of the fans CF (cooling fan motor).

The stem DS is hollow. For the reasons given above, mud is injected into the stem DS by means of a gooseneck GS, via a bonnet BO and a wash pipe packing assembly WP.

In its lower portion, visible in isolation in FIG. 3C, the drive TD comprises a PEP (powered elevator positioner) motor which can turn through 360.degree. about the axis of the stem DS. A backup clamp BUC is connected to the positioner PEP via a torque arrestor frame TAF. Elevators E provided with a hydraulic clamp HC are mounted at the end of elevator links EL of which the opposite end is attached to the positioner PEP via rotating link adapters RLA. The adapters RLA can be used to pivot the arms EL with respect to the axis of the drive stem DS under the action of a link tilt assembly fixed to the positioner PEP. The backup clamp BUC comprises adjustable stabilizing guides SG, not shown.

FIG. 3C also shows an upper safety assembly (upper blow out preventer), UBOP, and a lower safety assembly (lower blow out preventer), LBOP, interposed between the stem DS and a wear insert (saver sub), which cannot be seen. The backup clamp BUC, disposed above the hydraulic clamp HC, engages over practically the whole wear insert.

The drive TD is guided by a laterally offset vertical rail VR (FIG. 3A). The drive TD descends as drilling progresses until it is close to the floor of the derrick 10. Adding a length of tube is a little simpler than before. The drill string is locked by being strongly clamped and it is broken out from the stem DS, more exactly from a wear insert, termed the top drive saver sub, fixed beneath the lower safety assembly LBOP. In this case, there is only one wear component.

The motor is lifted towards the top of the derrick 10. One or more tubes are added. Then the drill string is made up again onto the wear component, remaining attached to the drive TD. The assemblies UBOP and LBOP respectively comprise an upper safety valve (upper kelly valve) UKV and a lower safety valve (lower kelly valve) LKV disposed one above the other between the stem DS and the wear insert SavSub. Conventionally, they retain their names "upper kelly valve" and "lower kelly valve" even though there is no longer a profiled stem known as a kelly in this embodiment.

Figure 4:
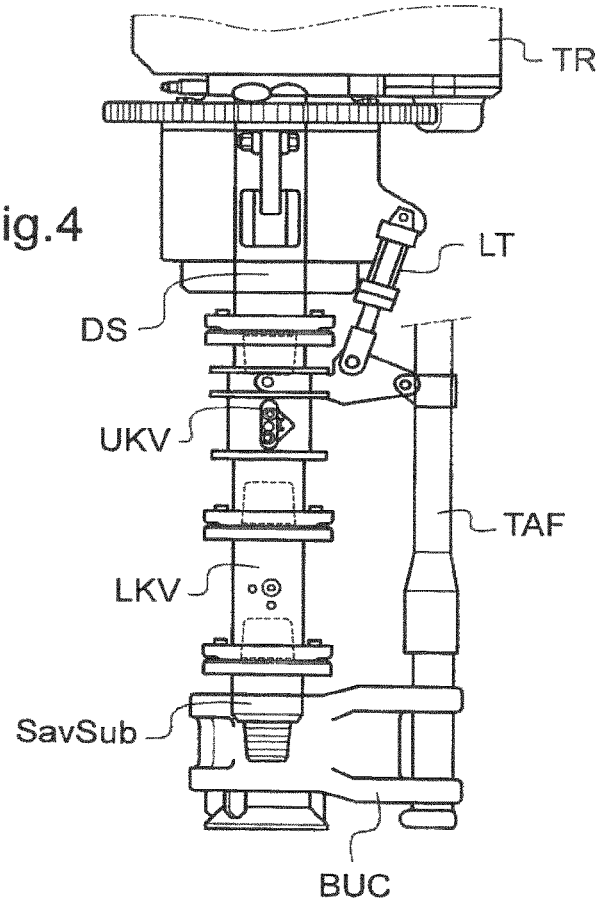
FIG. 4 shows the made up components used at the string head in the case of the drive of FIG. 3.
Figure 5A:
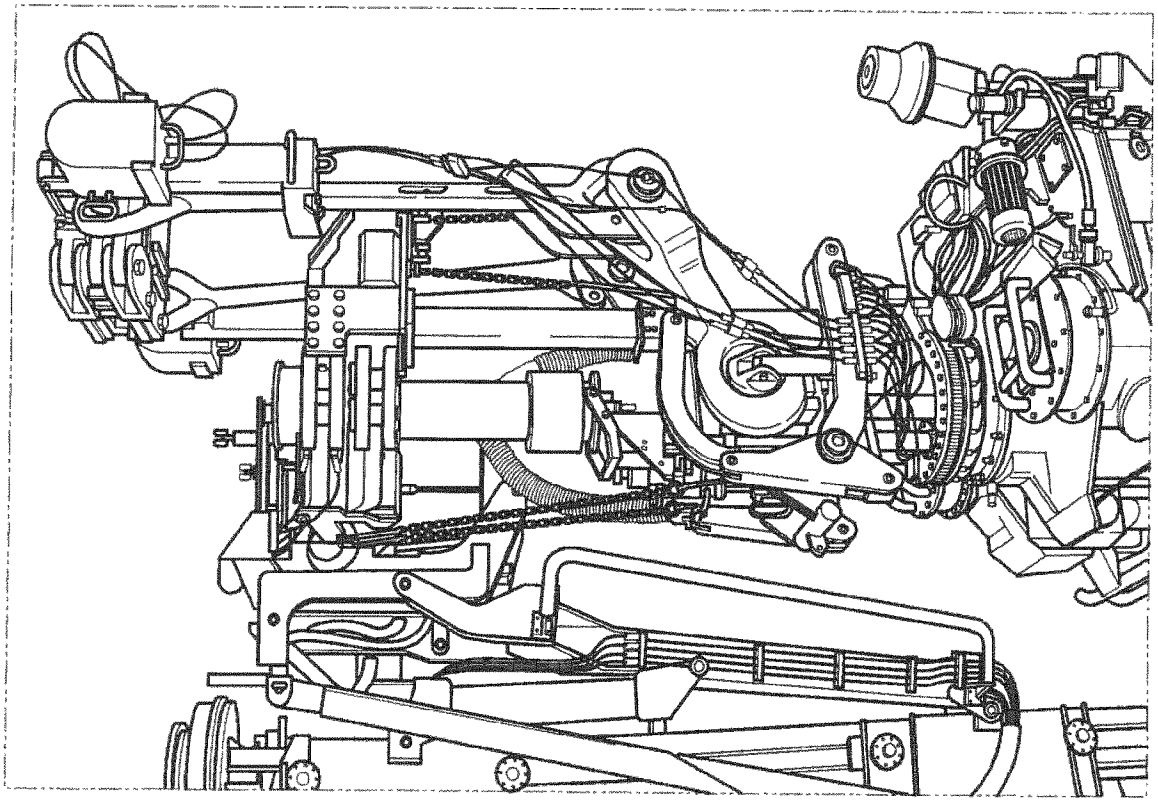
FIGS. 5A and 5B are two detailed partial views of well head equipment equipped with the drive of FIG. 3.
Figure 5B:
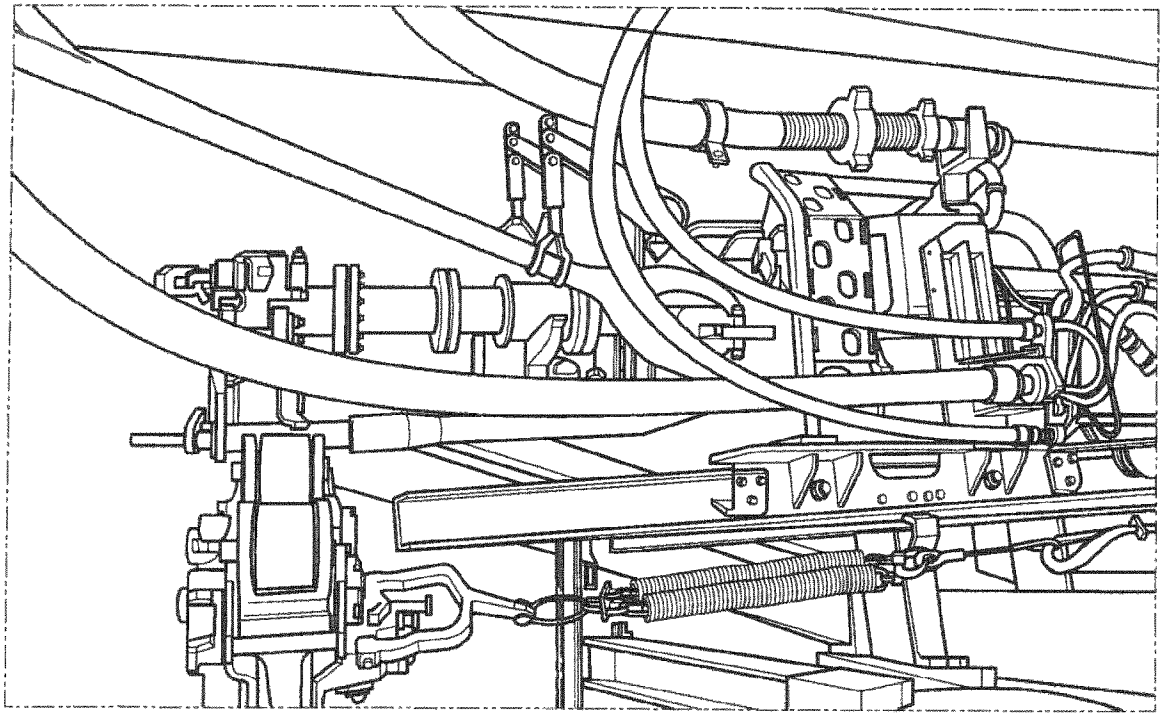

FIG. 4 shows the arrangement of the column head in the case of the well head equipment of FIGS. 3A to 3C.

The motor DM drives the stem DS which is threaded and engages on the upper safety valve UKV. In this embodiment, it is immediately followed by the lower safety valve LKV then the wear insert SavSub, in this case just one.

As already indicated, the aim now is to render the string communicative so as to be able to exchange information between the top of the well on the one hand and the bottom of the well on the other hand, or intermediate equipment inserted in the string. To this end, within the drill string, each tube is equipped with communication couplers (abbreviated to "couplers") at its ends and with an electrical connection between said couplers.

Known solutions to this problem have been described, in particular in the document "US DOE Report" with reference "Report #41229R14". This document is available at the following internet address: http.//www.net1.doe.gov/technologies/oil-gas/publications/epreports/dcs/final%20report%20fg123104.pdf Those solutions suffer from a number of disadvantages.

One of these solutions, known by the name "SwivelLink", integrates rotary union type transmission electronics into a specialized insert or sub, which will naturally be quite lengthy, in order to be able to house the transmission electronics. The internal cross section of flow has to be retained for the drilling mud in particular. The transmission electronics are located in a housing provided in the peripheral tubular wall of the insert, hence the length.

Using that first solution involves a complete rethink of the architecture of the well head equipment because of said length. This considerably limits the scope of this solution. Further, it involves revising all of the standards applicable to the well head elements, which has considerable consequences in terms of costs.

If, in contrast, this first solution were to be integrated into the top drive system of an existing well using current standards, then one of the top elements of the string would have to be sacrificed: by removing one of the two safety valves UKV and LKV, or by replacing the wear insert SavSub.

The document Report #41229R14 also describes a second solution, known as "Data Swivel", where the wear insert known as the saver sub is provided with an electrical rotary union wherein a portion which is fixed with respect to the derrick 10 is connected to a fairly long cable to accommodate the vertical excursion of the wear component during drilling.

However, as can be seen in FIG. 4, the backup clamp BUC engages on the wear insert over practically its entire length. Thus, there is a major risk of deterioration of the electrical rotary union and/or the cable carried by it when the wear insert is clamped by the hydraulic backup clamp. This deterioration is disastrous as the whole communication system of the drill string is then cut off. For the reasons given above, the wear insert cannot be lengthened, especially because the backup clamp BUC is at a fixed distance with respect to the remainder of the top drive TD: elongating the wear insert towards the top of the drill string would involve removing or shortening the elements which are normally located there even though they are safety devices; this would also mean that specific elements would have to be produced, and finally, almost all of the string head, the wear insert and the drive stem would have to be changed; elongation of the wear insert towards the bottom of the drill string would cause analogous disadvantages since the distance from the drive stem to the hydraulic clamp is also fixed.

Thus, at the moment, there are no completely satisfactory practical solutions.

The present invention will improve the situation. It will be described for the case of modern well head equipment in accordance with the principles shown diagrammatically in FIG. 3, i.e. with a top drive.

The Applicant carried out an in-depth examination of the practical function of the elements used in the cramped environment of a well head.

Known solutions are limited by the fact that the skilled person will not in principle modify a safety means in a substantial manner. Thus, in the second solution mentioned above, the rotary union has been installed in the wear component termed the saver sub, although it will encounter an environment which is dangerous for its rotary union.

Unexpectedly, the Applicant's studies have shown that it is possible to incorporate a rotary union into a safety valve of the kelly valve type, in contrast to that which would a priori have been assumed to be the case.

This is what will now be described with reference to FIGS. 6A and 6B.

Figure 6A:
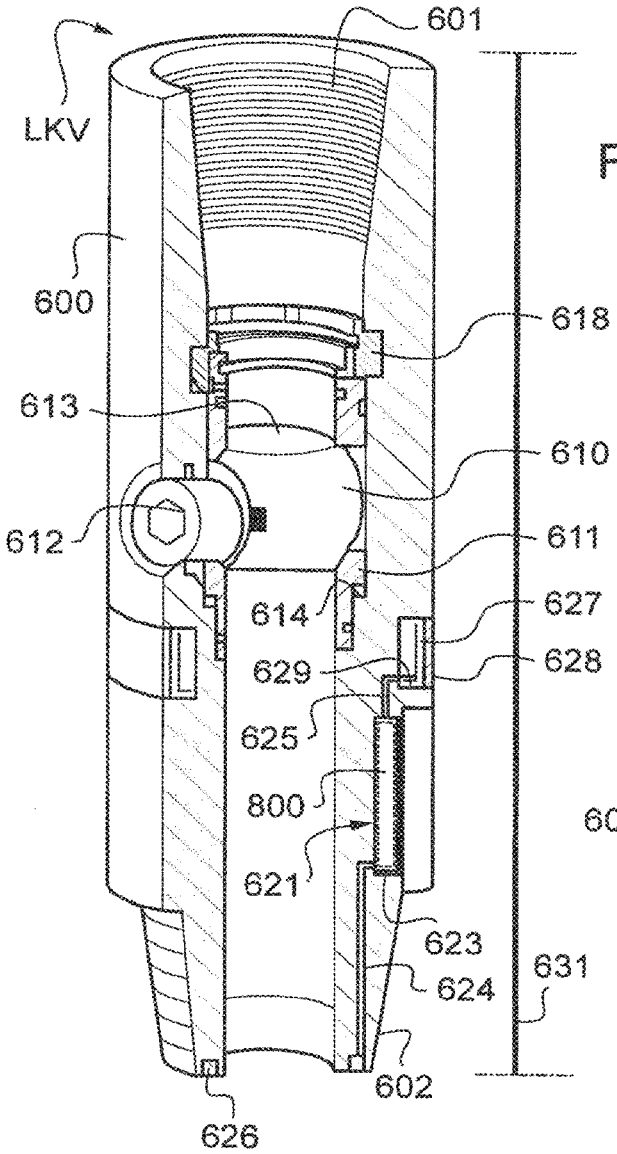
FIGS. 6A and 6B respectively represent two variations of a drill string element viewed in isometric, partially truncated perspective.
Figure 6B:
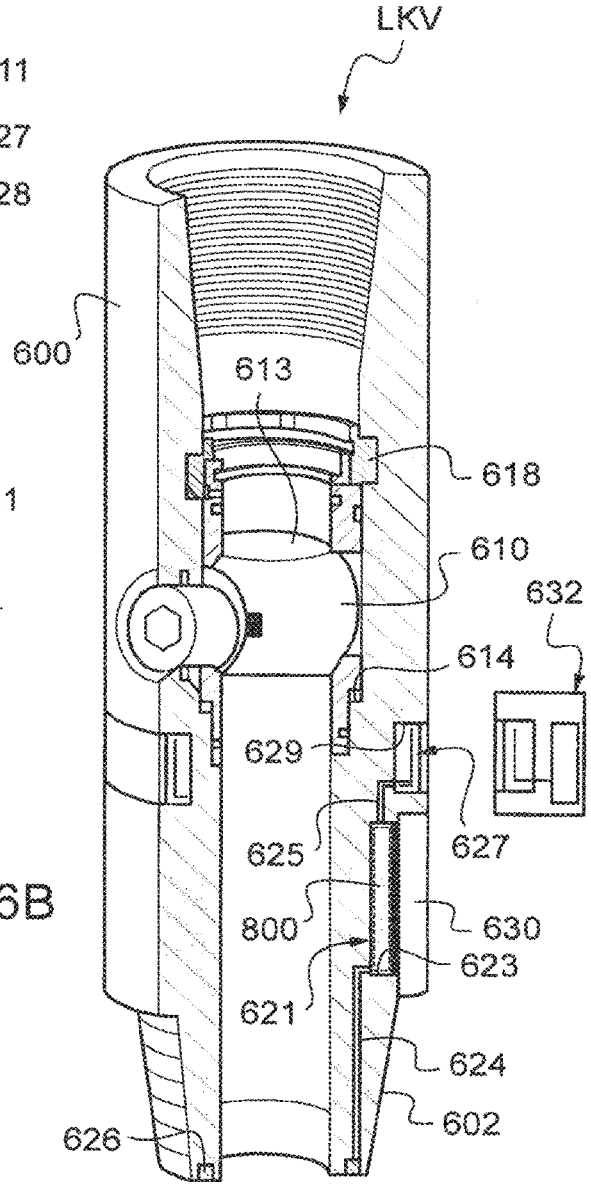

These FIGS. 6A and 6B show a safety valve which in this case is the safety valve LKV of FIG. 4. In conventional manner, it comprises a generally tubular structure or body 600 with an internal threading 601 at one end (upper end in FIGS. 6A and 6B) and an external threading 602 at its opposite end (lower end in FIGS. 6A and 6B).

In the intermediate portion, a spherical bead 610 is pivotally mounted in a guide 611. This is introduced by sliding it into the body 600 until it abuts against a shoulder 614. On the opposite side, the guide 611 is retained by a ring 618 housed in a peripheral groove provided inside the body 600. The spherical bead 610 is pierced with a cylindrical channel 613 with the same geometry as the interior of the body 600. In the example shown, pivoting of the bead may be controlled via an actuator having a hexagonal profile matching the indented shape 612 formed in the spherical bead 610. The spherical bead 610 can be pivoted between a position where the channel 613 is in the axis of the body 600 and a position where the spherical bead 610 obscures the interior of the body 600.

The Applicant has observed that the lower end of the valve LKV may be provided with a coupler 626 similar to the couplers used in the drill string. This coupler 626 is connected to a first electrical connection 624 having a longitudinal piercing, provided in the annular wall of the body 600 then a radial piercing which extends at a right angle until it reaches a recess 623 provided on the outer wall of the body 600. The recess 623 houses onboard electronics 621 which are connected via a second electrical connection 625 to a set of antennae 627 housed in an annular groove 629 also provided on the periphery of the body 600. The second electrical connection 625 has a longitudinal piercing provided in the annular wall of the body 600 and a radial piercing which extends at a right angle to the annular groove 629. The annular groove 629 is closed by a protective means which in this case is produced in the form of a cover 628 formed from a non-metallic material, for example formed from polytetrafluoroethylene (PTFE).

The recess 623 is closed by a protection which in this case is in the form of a cover 630 formed from an amagnetic material, for example a metallic material. The cover 630 is held on the body 600 in a leak-proof manner by means of a seal (not shown) and a set of screws. The thickness of the protection is adapted so as to guarantee it sufficient mechanical strength for the pressure and the torque produced.

The onboard electronics 621 and the set of antennae 627 form part of a wireless communication device which, in general, can be used to transmit data originating from the drill string to a surface network and to receive data originating in this surface network. The wireless communication device in question forms a part which may be termed a surface interface.

In the embodiment of FIG. 6A, the onboard communication device in the body 600 is intended to cooperate with at least one wire antenna 631, for example a leaky feeder, fixedly held in the well head equipment. The wire antenna 631 extends along it for at least the vertical excursion executed repetitively by the valve LKV, along with the top portion of the drill string. This excursion may be as long as several tens of metres depending on the drive technique employed.

In the embodiment of FIG. 6B, the onboard communication device in the body 600 is intended to cooperate with a surface communication device 632 which may be provided with a grommet (not shown) through which a vertical cable passes. The surface communication device 632 may remain fixed at the base of the well head equipment during the combined movements of sinking or rising and rotation executed by the valve LKV with respect to the derrick 10.

As can be seen in FIG. 4, the tubular element SavSub located below the safety valve LKV is normally a wear insert, or saver sub.

The Applicant has observed that the two ends of this wear insert could be provided with communication couplers while a connection between them passes along the wear insert, preferably in a channel pierced in the wall thereof, from one end to the other.

Figure 14A:
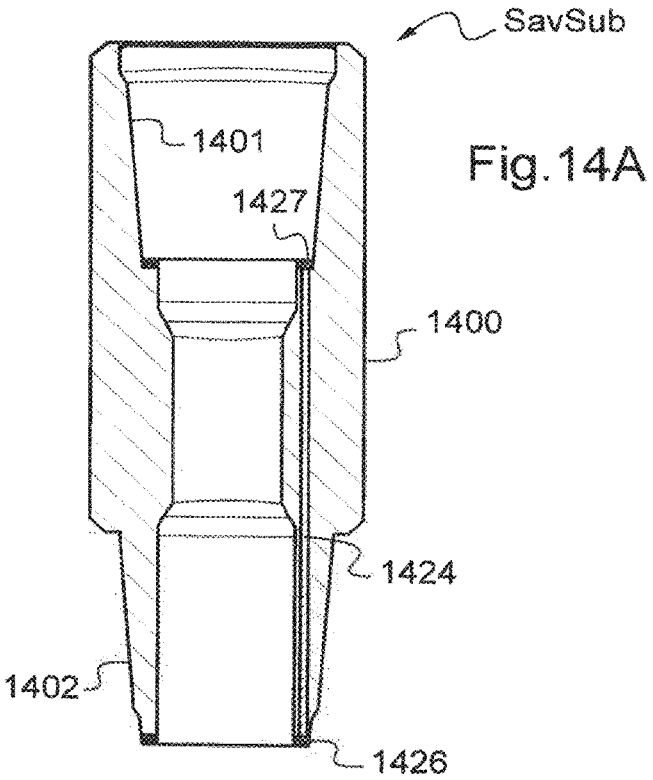
FIG. 14A represents a tubular insert in longitudinal section.

We shall now describe this with reference to FIG. 14A.

This FIG. 14A shows a wear insert which in this case is the wear insert SavSub of FIG. 4.

In conventional manner, the insert SavSub comprises a generally tubular structure 1400 with a threading 1401 at the upper end, compatible with the threading 602 of the lower end of the safety valve LKV, and a threading 1402 at the lower end. The threading 1402 of the lower end of the insert SavSub is compatible with the threadings used in the lower portion of the string.

The lower end of the insert SavSub is provided with a coupler 1426 similar to those which are used in the drill string. The upper end of the insert SavSub is provided with a coupler 1427 matching the coupler 626 of the safety valve LKV. In this case, the coupler 1427 at the upper end and the coupler 1426 at the lower end of the insert SavSub are analogous. These couplers are connected together by an electrical connection 1424 having a longitudinal piercing provided here in the annular wall of the tube.

In particular, the lower coupler 1426 of the insert SavSub may have the same dimensions as the couplers which are used in the drill string, while the upper coupler 1427 of the insert SavSub and the lower coupler 626 of the valve LKV may also have the same dimensions as those which are used in the drill string.

Figure 14B:
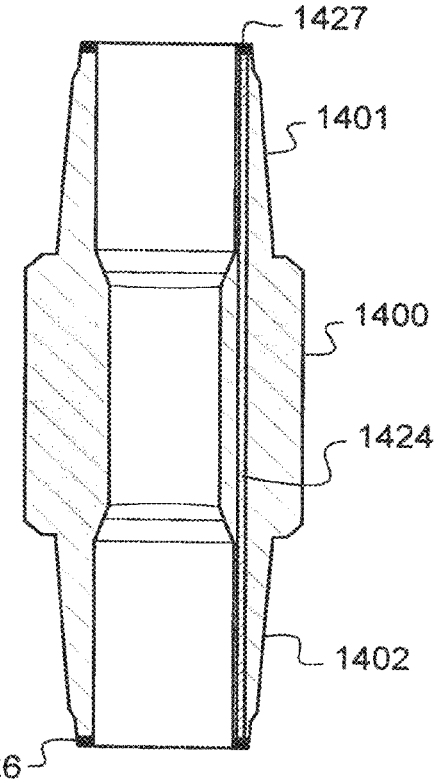
FIG. 14B represents a variation of the insert in a view analogous to FIG. 14A.

FIG. 14B shows a variation of the insert SavSub which differs from that illustrated in FIG. 14A in that its threading 1401 at the upper end is male in type rather than female. In this form, it is adapted to a valve LKV for which the lower end threading 602 is female in type. This means that the upper end coupler 1427 is housed close to the corresponding terminal face of the insert SavSub, while in the embodiment of FIG. 14A, this coupler 1427 is housed at the bottom of a bore provided to receive the lower end of the valve LKV. In other words, in FIG. 14B, the coupler 1427 at the upper end is close to the end of the threading 1401 which is distant from the lower end of the insert SavSub, while in FIG. 14A, this coupler 1427 is close to the end of the threading 1401 which is close to the lower end of the insert SavSub.

Figure 7A:
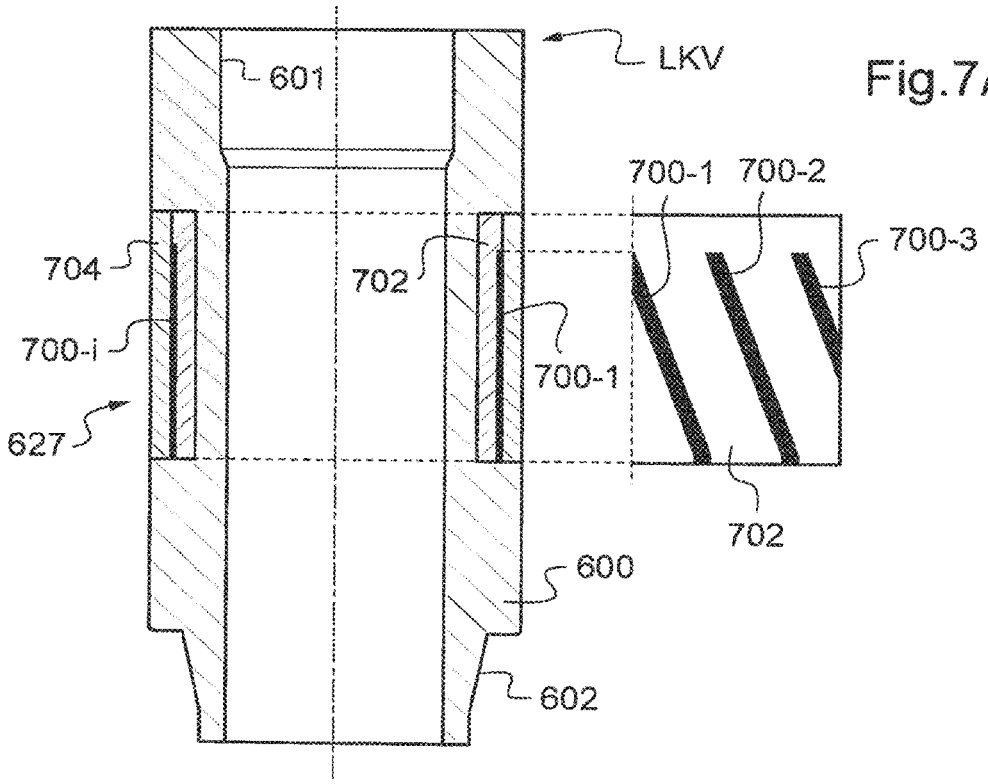
FIG. 7A represents a simplified block diagram of the of the elements of FIGS. 6A and 6B.

Reference will now be made to FIG. 7A.

The set of antennae 627 comprises a plurality of elementary antennae 700-*i* (i being a whole number from 1 to N, N being the number of antennae in said set), which are flat, and are printed on a substrate 702 and covered with a cover layer 704 produced from a non-metallic material. The cover layer 704 may be different from the protective means 628 (not shown in FIG. 7A).

The elementary antennae 700-*i* are disposed in a regularly distributed manner around the axis of symmetry of the body 600. The right hand portion of FIG. 7, which represents a portion of the set of antennae 627 in a developed form, shows, by way of example, elongated elementary antennae 700-*i* each being inclined with respect to the longitudinal direction of the body 600 such that each end of an elementary antenna 700-*i* is approximately aligned in the direction of the axis of symmetry of the body 600 in each case with a respective end of an adjacent elementary antenna 700-*i*. With such a disposition, the set of antennae 627 radiates in a substantially identical manner over the whole of the circumference of the body 600, at least over a longitudinal section of the body 600 comprising the set of antennae 627.

As an example, in this case the set of antennae 627 comprises eight elementary antennae 700-*i* (N=8).

Figure 7B:
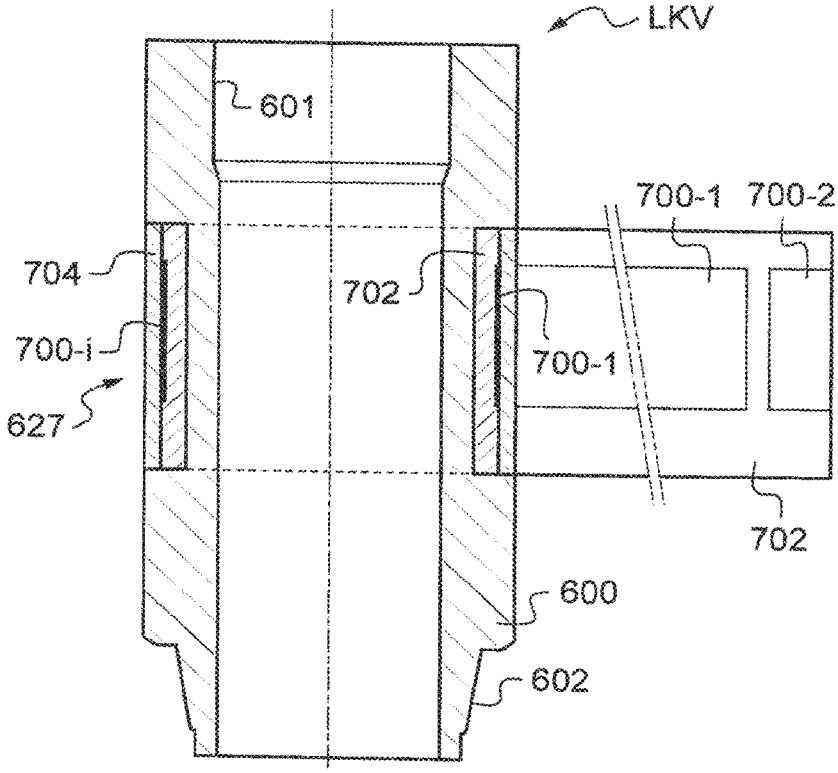
FIG. 7B represents a variation in a view analogous to that of FIG. 7A.

In a variation illustrated in FIG. 7B, the elementary antennae 700-*i* are flat antennae, also known in the art as patch antennae. These antenna can be used to produce antennae with good directional properties in a reduced space.

In this case, the flat antennae are rectangular leaky feeder antennae connected into an array via a set of hybrid couplers (not shown).

Figure 8:
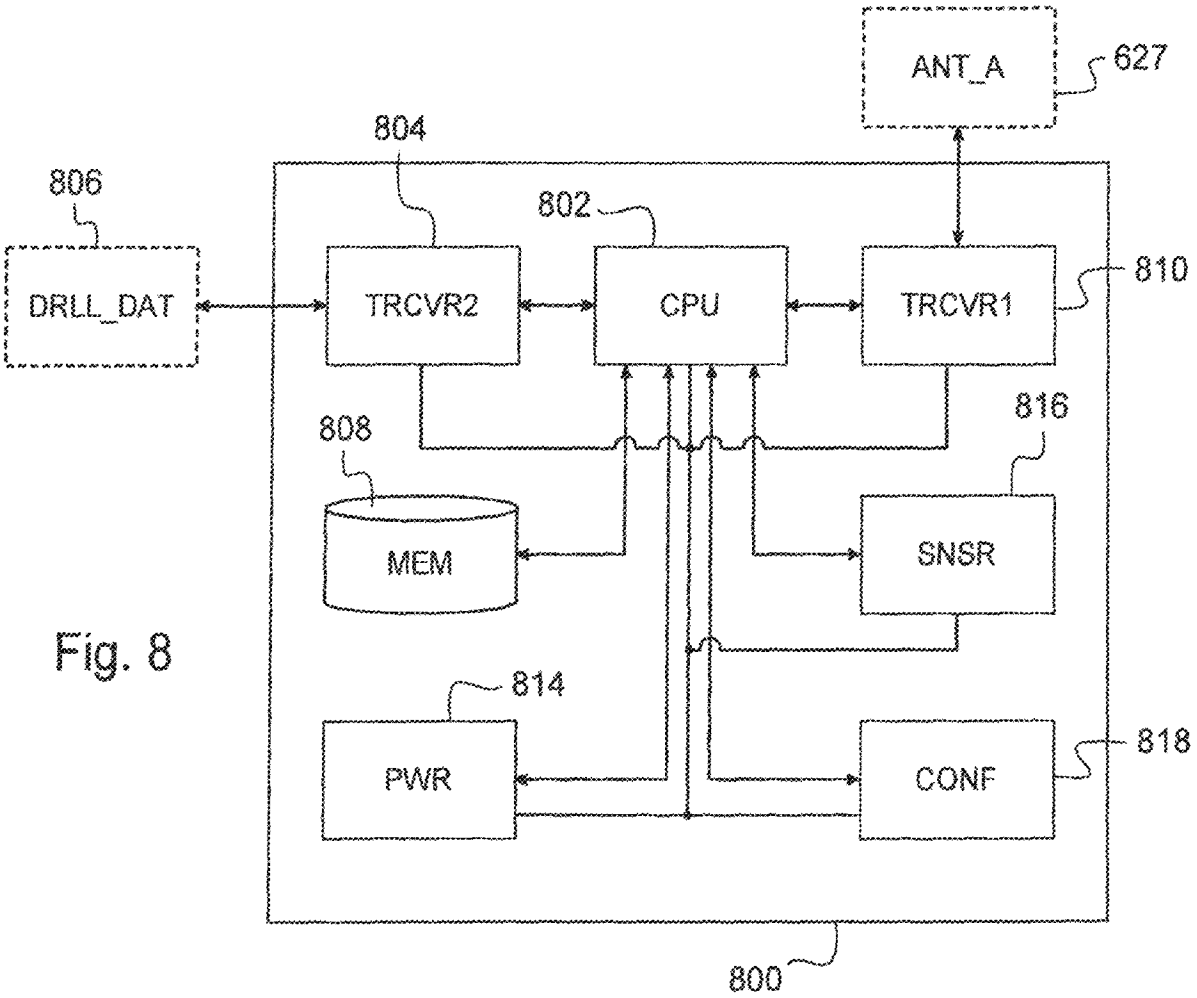
FIG. 8 represents a block diagram of the onboard electronics in the elements of FIGS. 6A and 6B.

FIG. 8 illustrates the function of a set of components 800 for the onboard electronics 621.

The set of components 800 comprises a first transceiver circuit 810 connected in a two-way manner to the set of antennae 627, which manages the communication between the set of antennae 627 and the fixed antenna installed on the well head equipment, and a second transceiver circuit 804 in charge of the two-way transmission of data with the devices installed in the drill string, which devices are represented as a whole by the dashed line frame with reference numeral 806.

The set of components 800 also comprises a memory 808 in which useful data can be stored, in particular data originating from the drill string to be transmitted to the surface network and data originating from this network to be routed to the drill string. As an example, the memory 808 acts in the manner of a buffer memory.

The set of components 800 also integrates one or more batteries 814 which supply the onboard electronic elements 621 including a microprocessor 802 which makes all of these elements operate in an integrated manner.

As an option, the set of components 800 comprises a "local" communication interface 816 connected to sensors installed in the valve LKV and which measure the functional characteristics of the onboard electronics 621 and/or the valve LKV itself. These characteristics may, in a non-limiting manner, comprise data regarding the vibrational characteristics of the valve LKV, the pressure inside said valve, or the temperature.

Optionally again, the set of components 800 comprises a configuring interface 818 through which the microprogram of the microprocessor 802 may be updated and/or data can be recovered from the memory 808 and/or the onboard electronics 621 or even the valve LKV itself, can be tested and/or configured, inter alia.

Figure 9:
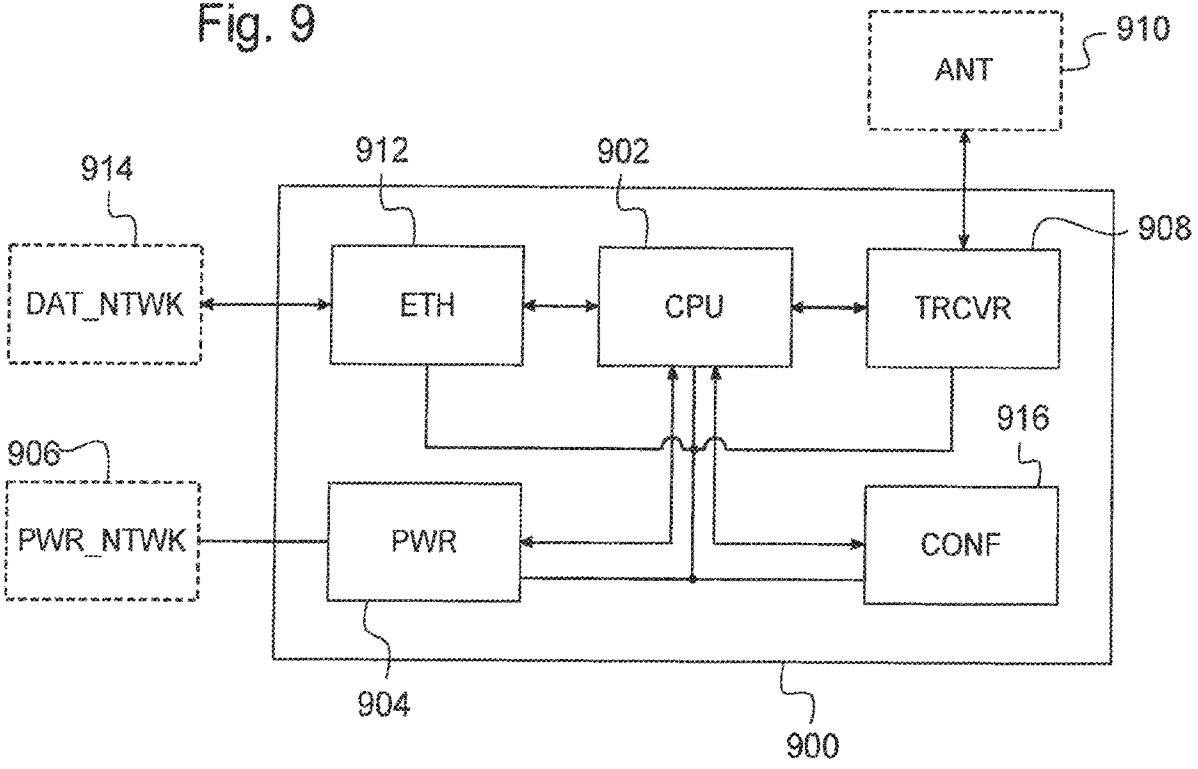
FIG. 9 represents a block diagram of the surface electronics for use in combination with the elements of FIGS. 6A and 6B.

FIG. 9 represents the function of surface electronics 900 which cooperate with one or more fixed antennae with a view to communicating with the onboard device in the valve LKV. The surface electronics 900 also form a part of the device termed the surface interface.

The surface electronics 900 comprise a central processing unit 902 supplied via a current transformer 904 connected to an energy distribution network shown as the dashed line frame with reference 906. Replacing it or as a complement to it, the surface electronics 900 may be provided with one or more batteries, in particular as an energy source if the power distribution network should fail.

The surface electronics 900 integrates a transceiver circuit 908 which provides digital type two-way communication with the processing unit 902 and two-way communication with the antenna 910, which latter may be of the wire type as in the embodiment of FIG. 6A or of another type, for example in accordance with the embodiment of FIG. 6B.

The surface electronics 900 also include a second input/output interface, in this case of the Ethernet type, connected to a data exchange network represented here as the dashed line block 914, and a configuration circuit 916 connected to the processing unit 902 and optionally accessible via a standard type input/output interface, for example of the USB (universal serial bus) type.

Figure 10:
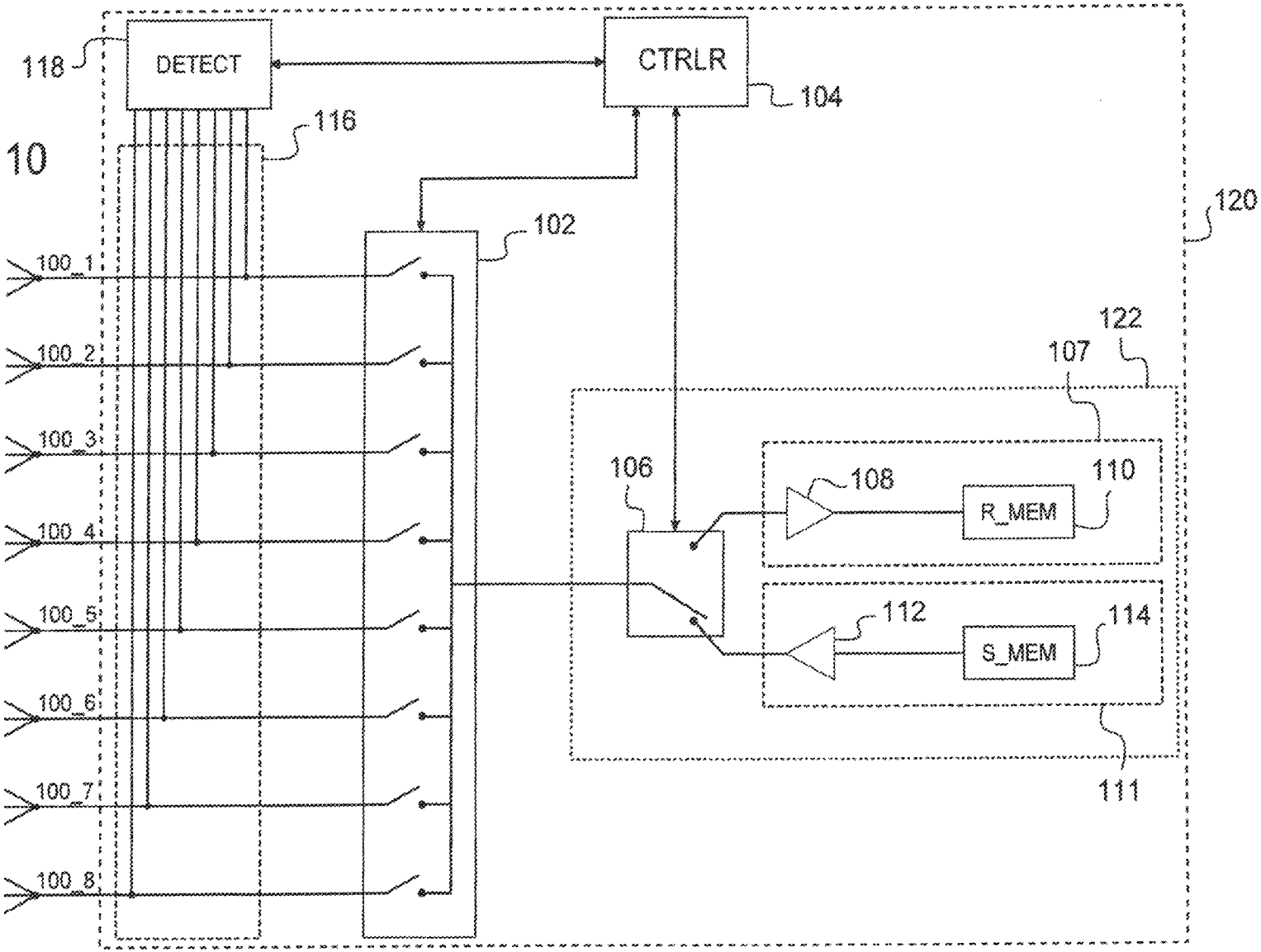
FIG. 10 illustrates an example of an embodiment of a portion of the electronics of FIG. 8.

FIG. 10 shows a portion of the set of components 800 intended to transmit/receive data via the set of antennae 627.

The transmission lines for the various elementary antennae 700-*i* are respectively referred to therein as 100-1, 100-2, . . . 100-8.

Each transmission line 100-*i* (i=1, . . . , 8) is connected to a respective switching gate of a switching circuit 102 including an input/output gate which is connected to an input/output gate of a two-way switch 106. The switching circuit 102 is capable of selectively connecting, in this case under the control of a microprocessor 104, one or more transmission lines 100-*i* to the input/output of the switch 106.

The switch 106 has a first switching gate connected to a reception line 107 and a second switching gate connected to a transmitting line 111. Under the control of the microprocessor 104, the switch 106 can pass from a first switching state in which the reception line 107 is connected to the input/output gate of the switching circuit 102, the set of antennae 627 thus acting in reception mode, to a second switching state in which the transmission line 111 is connected to the input/output gate of the switching circuit 102, the set of antennae 627 then operating in transmission mode. The switch 106, the reception line 107 and the transmission line 111 form operating electronics which are capable of operating in transmission or reception mode depending on the switching state of the switch 106.

Although in this case the microprocessor 104 controls both the switching circuit 102 and the switch 106, in a variation, it is possible to control both devices by means of distinct dedicated microprocessors.

The reception line 107 comprises an amplifier-adapter 108 and a reception memory 110, while the transmission line 111 comprises an amplifier-adapter 112 and a transmission memory 114. Although not shown in the figures, the amplifier-adapter 108 of the reception line 107 and the amplifier-adapter 112 of the transmission line 111 may be controlled by the microprocessor 104.

The reception memory 110 and the transmission memory 114 may be organized within the same electronic device.

This portion of the set of components 800 also comprises a detection circuit 118 to which each of the transmission lines 100-1 to 100-8 are connected via a respective input. The detection circuit 118 is capable of establishing a signal representing a reception power as measured at its inputs on each of the transmission lines 100-1 to 100-8 corresponding to the elementary antennae **700-*i* of the set of antennae 627 and, if appropriate, to deliver that signal to the output, in this case the microprocessor 104**.

FIG. 11 illustrates the function of the onboard electronics as regards transmission and reception of data.

In an operation 1100, the onboard electronics 800 are initialized at least as regards the elements described in relation to FIG. 10. The transmission line is in reception mode (the switch 106 is on the reception line 107). The signal derived from the detection circuit 118 is acquired.

An operation 1102 verifies whether the set of antennae is at least partially operational, i.e. that at least one of the antenna elements is capable of receiving a signal from the fixed antenna. For example, the detection circuit 118 is checked as to whether it measures a reception power value of more than a threshold value for at least one of the elementary antennae 700.

If not, the operation 1102 is recommenced until at least one antenna is operational.

When the test 1102 for operation is positive, during an operation 1104, reception of a packet of data and transmission of another packet of data are organized.

Next, the data received and/or the data to be transmitted to the next transmission/reception step are processed during an operation 1106. During this processing operation, it is in particular checking if the packet of data received is integral, in other words whether the data received form a complete packet. Encapsulation of the data into packets for transmission is also checked.

This succession of operations may be carried out in the form of a function of a microprogram executed by the microprocessor 104. However, there is no impediment to using exclusively electronic logic circuits to carry it out.

Figure 12:
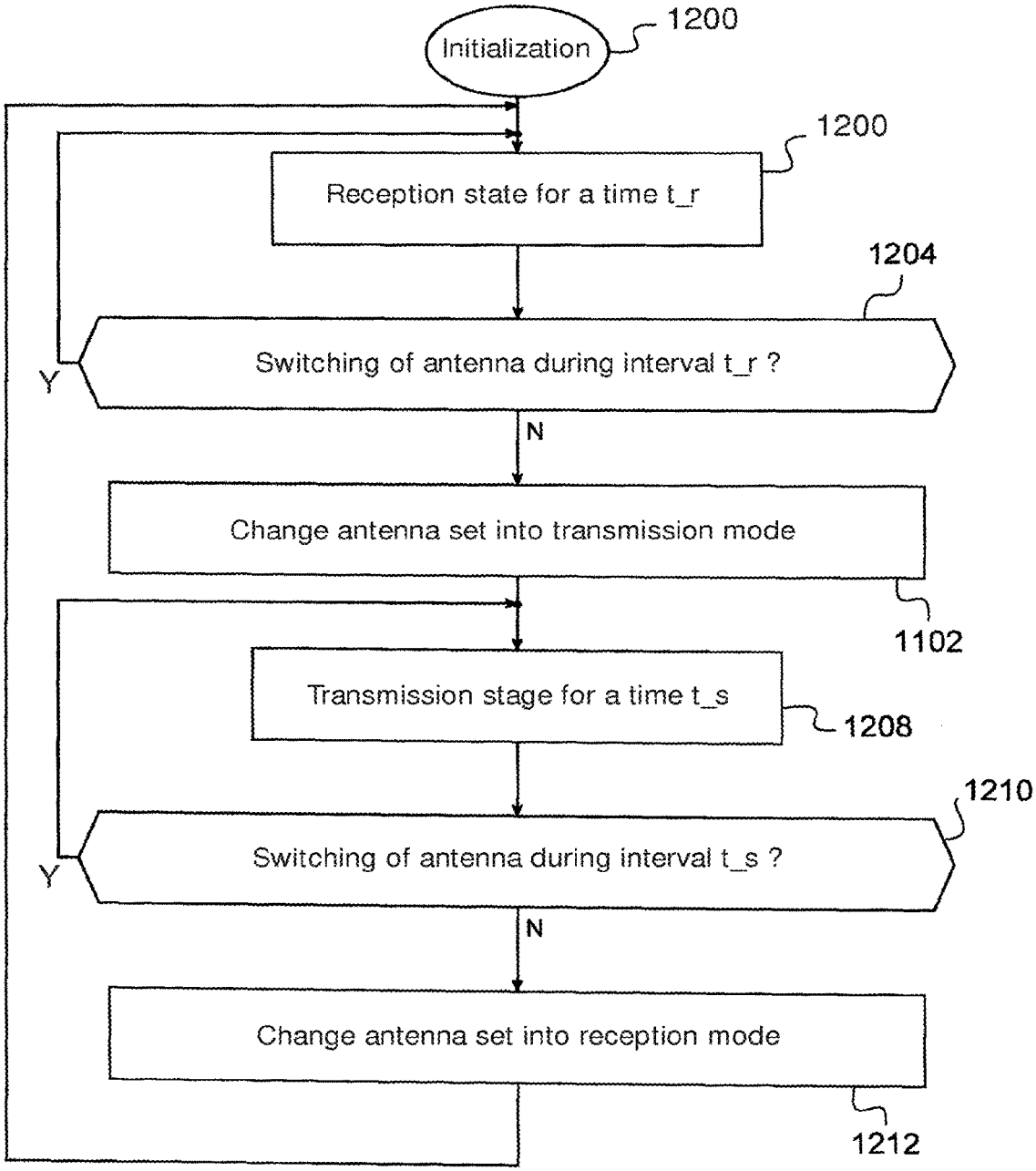

FIG. 12 details the operation of transmission and reception of a data packet.

This operation commences with an initialization step 1200. This initialization step in particular comprises a phase for synchronization between the onboard electronics 800 and the surface electronics 900 in order to define respective time windows for transmission and reception of a data packet.

In step 1202, the onboard electronics 800 are in a reception state. This means that the switch 106 is switched onto the reception line 107, which may undergo a supplemental test. In practice, the switch 106 has a default switching state which corresponds to the reception mode. The reception state also involves operation of the amplifier-adapter 108. Received data are written to the reception memory 110. This reception step is finished when a time period t_r, set during the synchronization with the surface electronics 900, has elapsed. We shall see below how to evaluate this period t_r in an advantageous manner.

When the time t_r has elapsed, step 1204 tests whether, during period t_r which has just elapsed, there has been a change in state in the switching circuit 102.

If yes, then step 1202 is recommenced. In other words, the onboard electronics 800 are once again placed in data reception mode for a new time period t_r. The time t_r that this reception period lasts may be subject to a new synchronization. In other words, the duration of the reception time period may be adapted each time that this step 1202 is recommenced. This means that the fact that the switching circuit 102 may be switched too frequently to allow reception of a complete data packet in the negotiated time period t_r can be taken into account.

If the test of step 1204 is negative, then the onboard electronics are toggled into transmission mode, in step 1208. This means that the switch 106 is toggled onto its second switching gate and that the amplifier-adapter of the transmission gate is made operational. This packet transmission step is complete when a time period t_s, the duration of which has been negotiated during the preceding synchronization step, has elapsed.

When the time period t_s has elapsed, a test as to whether there has been a switch in the switch 102 during this time interval is carried out in step 1210.

If yes, then the transmission step 1208 is recommenced for a new time period t_s, with a duration equal to or different from the preceding time period t_s.

If the interval t_s has elapsed without an intervening switch, then the set of antennae 627 is toggled into reception mode during step 1212, i.e. the microprocessor 104 transmits a switching signal to the switch 106 which links the reception line 107 to the input/output gate of the switching circuit 102.

The steps just described may be carried out by executing a function of a microprogram of the microprocessor 104.

FIG. 13 illustrates the function of the onboard electronics as regards switching the elementary antennae **700-*i* of the set of antennae 627**.

After an initialization operation 1300, a test is carried out as to whether the set of antennae is at least partially operational during a step 1302.

In particular, this test consists of checking that a minimum reception power can be measured on at least one of the transmission lines **100-*i*** (i=1, . . . , 8).

If the test of operation 1302 is negative, then operation 1302 is recommenced until it is positive, if necessary after a delay.

In operation 1304, one or more selection criteria pertaining to all of the elementary antennae **700-*i*** that have been adjudged operational is evaluated. At this moment, the best performing antenna or antennae for communication are determined.

In one embodiment, the antenna line **100-*i* on which the highest reception power is measured is selected. In this embodiment, the available transmission power is concentrated on a single elementary antenna 700**, which means that very high performance as regards rate and energy savings can be obtained.

In a variation, a sub-assembly of transmission lines could be selected, for example all of the transmission lines for which a reception power greater than a predetermined base value is measured may be selected.

In yet another variation, it is also possible to select the line on which the highest reception power is measured or several lines on which the highest reception powers are measured, i.e. higher than the reception powers measured on the other lines. In this case, the selection may be conditioned by the fact that the reception power measured on the selected lines is greater than a base value for the power.

The selected antenna or antennae may also comprise one or more elementary antennae close to the antenna corresponding to the transmission line on which the highest reception power is measured, in particular if several fixed antennae are used at the surface.

In yet another variation, the power levels measured by the detection circuit 118 may only be taken into account in a secondary manner for the selection of the elementary antenna or antennae. As an example, with the elementary antenna which is active at the present moment being identified (for example by means of a stored register), the elementary antenna selected in operation 1304 may be the antenna adjacent to the current antenna (higher or lower identifier) on the transmission line on which the highest reception power is measured. Again as an example, with the currently active elementary antenna and a direction of rotation of the body 600 (known by extrapolating the change in the reception power of an antenna line, typically the antenna line which corresponds to the currently activated antenna, and the change in slope) being known, the antenna selected during operation 1304 may be the next antenna (with a higher or lower identification number) provided that the measured reception power is higher than a threshold value.

In operation 1306, the switching circuit 102 is commanded to connect the switching gates corresponding to the transmission lines of the selected antennae to its input/output gate.

Operation 1308 tests whether one or more switching conditions are satisfied. These switching conditions are intended to determine when it is opportune to carry out a modification to the set of active antennae.

A first condition may comprise evaluating the reception power of the currently active antenna and comparing the measured power level with a base value, this first condition being satisfied if the measured power is less than a base value.

A second condition may comprise comparing the reception powers measured on the transmission lines corresponding to a sub-assembly of the set of antennae 700. As an example, the second condition is satisfied if there is a transmission line which is different from the line corresponding to the currently active line on which a reception power which is greater than the currently active antenna is measured.

A third condition may include the elapse of a predetermined time period, for example evaluated on the basis of a rate of rotation of the body 600.

The operation 1308 is recommenced when the switching conditions are not satisfied.

The operations described in relation to FIG. 12 may be carried out by executing one or more functions of the microprogram of the microprocessor 104, a microprocessor dedicated to controlling the detection circuit and the switching circuit 102, and/or a specific circuit.

The detection circuit 118, jointly with the microprocessor 104 with which it exchanges data, acts like an elementary antenna monitor which repetitively evaluates the reception power of each of these elementary antennae as regards being a reception quality parameter, or of a sub-assembly of the set of antennae 627. The detection circuit 118, jointly with the microprocessor 104, repetitively selects one or more elementary antennae from said set as a function of the reception quality parameters derived from said sub-assembly and commanding the switching circuit 102, which acts as an actuator, to connect the thus selected antenna or antennae which may be called the operating electronics, i.e. the transmission line 111 and reception line 108.

We shall now return to the processing step described above in relation to FIG. 13.

Because the elementary antennae 700-*i* are distributed in a regular manner about the axis of symmetry of the body 600, which corresponds to its axis of rotation when the drill string is working, this means that at all times the power level is higher than a base level in transmission and in reception, at least when the surface interface is functioning normally. By repetitively switching the best performing active elementary antennae over an interval of time, energy consumed by transmission of data is saved. In other words, directive elementary antennae have been produced which can, thus, be controlled in order to limit energy losses. On this point, the use of high transmission frequencies, for example of the order of 2.45 GHz, further improves the directivity of the elementary antennae.

The minimum power level is maintained due to switching of the active elementary antennae which is regular, selective and conditional to a greater or lesser extent.

The switching frequency depends on many parameters, especially the change in the conditions for the propagation of radiofrequency waves in the well head equipment, which conditions might be influenced by many fairly unpredictable parameters, such as the presence of equipment between the body 600 and the fixed antenna, for example. It should be noted that the negative effect of these unpredictable phenomena on transmission is minimized because generally, the best performing antenna or antennae are switched (and not necessarily that facing the fixed antenna).

The rate of rotation of the body 600 with respect to the fixed antenna may influence the frequency of switching of the elementary antennae 700, and as a result the duration of the time window effectively available for transmission and reception of data.

Given a threshold transmission power level, above which it is assumed that data transmission is opportune, the increase in the rate of rotation of the drill string tends to reduce the time window effectively available for an elementary antenna, while a reduction in this rate tends to increase this time window.

Advantageously, the processing carried out on the data packets can be adapted to take this into account.

In one embodiment, the data to be transmitted are encapsulated into packets with a size that is likely to vary with time as a function of the switching frequency, which may be evaluated on the basis of a history (a mean of the switching frequency in a past time interval, for example) or on that of a rate of rotation. In other words, the size of the packets transmitted and received is adapted as a function of the time window offered each time by an elementary antenna 700.

It is also possible to provide fixed size packets. The packet size may then be estimated on the basis of a maximum rotation rate for the drill string, either real (for example 120 rpm) or theoretical (for example 250 rpm).

Within a time window, at least one interval is appropriately organized for reception, with duration t_r, and an interval for transmission, with duration t_s. These durations t_r and t_s may be deduced, if necessary, from the time window available on an elementary antenna 700, such that the duration of this window is known, estimated, measured or assumed. The durations t_s and t_r are not necessarily identical given that in the application described here, the information to be extracted from the drill string is greater in quantity than the information to be transmitted to said string.

As has been seen, the solution proposed here is a complete rethink of the usual ideas of the skilled person. This comes firstly from the provision of a communication device on a safety element, namely a valve.

In contrast, known solutions, in particular US 2010/0224409, place the rotary union on the wear insert even though this is located close to mechanical means operating under load, such as the hydraulic clamp. There is thus a serious risk of damage to the rotary union and its connection cable with the surface interface, and thus of inadvertent interruption to service.

Further, it is normal to periodically "recondition" the threadings of the wear insert. The presence of an electrical union on it poses problems if its threadings are to be reconditioned under economically acceptable conditions. The variation consisting of making the wear component a dispensable component is also not economically desirable.

US 2010/0224409 proposes the production of a communication device which is at least partially removable, but this renders manufacture of the wear insert still more complex.

The solution proposed here avoids this problem. The wear insert is provided with end couplers and a cable, in a manner similar to that for the tubes of the drill string. It does not have the outer projecting portion which forms part of the rotary union. Thus, the threadings of the wear insert can be reconditioned using the same techniques as those used for the tubes of the drill string. The wear insert retains its strength qualities, which are critical in this region of the string. The cost of reconditioning the wear insert is optimized compared with known solutions such as "Data Swivel" or SwivelLink". The overall bulk of the wear insert is reduced to a minimum.

Providing the communication device on the valve LKV also means that this valve can have at least two clamping positions, namely above the set of antennae and below it, because of the length of this valve.

As explained above, the invention is not limited to the case of top drive drilling, but may also be envisaged in combination with a profiled stem of the "kelly" type. In this case, the valve LKV described here could be used as an upper kelly valve while the profiled stem (kelly), the safety valve (lower kelly valve) and the lower wear insert (lower saver sub) could each be equipped with end couplers and a cable electrically connecting said couplers.

The valve LKV described could also be provided in the form of a pneumatic valve.

Although the communication device described above has numerous advantages when it is integrated into a safety valve of the kelly valve type, at least some of these advantages are also enjoyed when the device in question is installed in an axisymmetric element of the drill string.

The device described can provide a substantial saving in the energy consumed by the data transmission operations. This is of particular importance in the drilling field as the devices in question, like all of the onboard electrical devices in the drill string, must be autonomous and as a result are supplied by onboard batteries. However, exhaustion of a battery may have particularly disastrous consequences as replacing it requires stopping production and/or drilling.

More precisely, the device proposed here offers optimized management of the energy dedicated to data transmission, since all of the available power is always attributed to the best performing antenna or a sub-assembly of the set of antennae, the other antennae being rendered passive. This is improved still further by using highly directive antennae, which mean that the antenna or antennae to be used at a given moment can be selected efficiently. It should be noted that although at any moment only a portion of the set of antennae is activated, the proposed device means that substantially continuous data transmission can be obtained even in the case of using a single fixed antenna. This transmission may be carried out at higher rates and with remarkable energy performances.

The device proposed can also be used for data transmission of the TDMA, time division multiple access, type.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An element for a drill string, comprising:

a body with an axisymmetric appearance; and a communication device installed in the body, wherein the communication device comprises:

a set of antennae including a plurality of antennae distributed at a periphery of the body, about an axis of symmetry thereof, and configured to operate in transmission and in reception;

operating electronics configured to organize transfer of data, in transmission and in reception, in packets, wherein a size of the packets is based on a rate of rotation of the body;

an actuator configured to selectively connect the antennae of the set to the operating electronics;

an antenna monitor configured to regularly evaluate a reception quality parameter for at least one sub-assembly of the set of antennae, to repetitively select one or more antennae of the set as a function of reception quality parameters derived from the sub-assembly, and to command the actuator to connect the selected antenna or antennae to the operating electronics.

2. An element according to claim 1, wherein the selected antenna or antennae include one or more antennae selected from the sub-assembly and/or one or more antennae close to the antennae of the sub-assembly.

3. An element according to claim 1, wherein the antenna monitor is further configured to regularly evaluate a switching criterion and to operate the actuator each time the switching criterion is verified.

4. An element according to claim 3, wherein the switching criterion includes a comparison between a time elapsed from a last activation and a predetermined time period.

5. An element according to claim 4, wherein the predetermined time period is calculated from a value for the rate of rotation of the body, taking into account the distribution of the antennae about the axis of symmetry of the body.

6. An element according to claim 5, wherein the value for the rate of rotation is determined from a change with time of a reception quality parameter of at least one of the activated antennae.

7. An element according to claim 3, wherein the switching criterion includes a comparison of substantially instantaneous values for the reception quality parameters relating to the activated antennae and to the other antennae of the sub-assembly.

8. An element according to claim 1, wherein the operating electronics is configured to toggle repetitively between a reception mode and a transmission mode.

9. An element according to claim 1, wherein the set of antennae includes a plurality of surface antennae distributed regularly about the axis of symmetry of the body.

10. An element according to claim 1, wherein the body houses a safety valve.

11. A device for a well head, comprising:

at least one element, the element having:

a body with an axisymmetric appearance; and a communication device installed in the body, wherein the communication device comprises:

a set of antennae including a plurality of antennae distributed at a periphery of the body, about an axis of symmetry thereof, and configured to operate in transmission and in reception;

operating electronics configured to organize transfer of data, in transmission and in reception, in packets, wherein a size of the packets is based on a rate of rotation of the body;

an actuator configured to selectively connect the antennae of the set to the operating electronics;

an antenna monitor configured to regularly evaluate a reception quality parameter for at least one sub-assembly of the set of antennae, to repetitively select one or more antennae of the set as a function of reception quality parameters derived from the sub-assembly, and to command the actuator to connect the selected antenna or antennae to the operating electronics.

12. A device according to claim 11, wherein the body of the element includes an upper end threading, a lower end threading, an end coupler, arranged at its lower end, configured to cooperate with a matching end coupler of another element made up onto the lower end threading, and an electrical connection arranged between the end coupler and the operating electronics.

13. A device according to claim 12, further comprising a valve arranged in an intermediate portion of the body between the upper end threading and the lower end threading.

14. A device according to claim 11, wherein the device is attached to a drive in rotation with respect to a derrick and one or more antennae that are fixed with respect to the derrick.

15. A method for communication by a drill string element including a body with an axisymmetric appearance and a set of antennae, including a plurality of antennae distributed at a periphery of the body about its axis of symmetry, and configured to operate in transmission and reception, the method comprising:

a) evaluating at least one reception quality parameter for at least one sub-assembly of the set of antennae;

b) selecting one or more antennae of the set as a function of the reception quality parameter or parameters derived from the sub-assembly; and c) organizing a transfer of data in packets, in transmission and/or reception, via the selected antenna or antennae, wherein a size of the packets is based on a rate of rotation of the body.

16. A method according to claim 15, wherein the evaluation is regularly carried out.

17. A method according to claim 15, wherein the selection is carried out repetitively.

* * * * *